US007413398B2

(12) United States Patent
Bangert et al.

(10) Patent No.: US 7,413,398 B2
(45) Date of Patent: Aug. 19, 2008

(54) POWER TONG POSITIONER

(75) Inventors: Daniel S. Bangert, Broussard, LA (US); Clint Michael Musemeche, Youngsville, LA (US)

(73) Assignee: McCoy Corporation, Alberta (CA)

( * ) Notice: Subject to any disclaimer, the term of this patent is extended or adjusted under 35 U.S.C. 154(b) by 427 days.

(21) Appl. No.: 10/769,279

(22) Filed: Jan. 30, 2004

(65) Prior Publication Data

US 2004/0195555 A1 Oct. 7, 2004

Related U.S. Application Data

(60) Provisional application No. 60/459,342, filed on Apr. 1, 2003.

(51) Int. Cl.
*B66F 11/00* (2006.01)

(52) U.S. Cl. ..... 414/745.2; 81/57.34; 414/745.2

(58) Field of Classification Search ..... 414/745.1, 414/623, 736, 621, 911, 749.5, 745.2; 81/57.35, 81/57.34, 57.16, 57.24; 166/77.53, 77.4
See application file for complete search history.

(56) References Cited

U.S. PATENT DOCUMENTS

| | | | | |
|---|---|---|---|---|
| 3,505,913 | A * | 4/1970 | Dickmann et al. | 81/57.35 |
| 3,881,375 | A * | 5/1975 | Kelly | 81/57.35 |
| 4,023,449 | A * | 5/1977 | Boyadjieff | 81/57.16 |
| 4,202,225 | A * | 5/1980 | Sheldon et al. | 81/57.35 |
| 4,348,920 | A | 9/1982 | Boyadjieff | |
| 4,402,239 | A * | 9/1983 | Mooney | 81/57.16 |
| 4,563,956 | A * | 1/1986 | Wiechert et al. | 105/29.1 |
| 4,612,996 | A * | 9/1986 | Wolf et al. | 172/26 |
| 4,667,752 | A * | 5/1987 | Berry et al. | 175/85 |
| 5,099,725 | A * | 3/1992 | Bouligny et al. | 81/57.34 |
| 5,259,275 | A * | 11/1993 | Schulze-Beckinghausen | 81/57.16 |
| 5,664,310 | A * | 9/1997 | Penisson | 29/407.02 |
| 6,142,041 | A * | 11/2000 | Buck | 81/57.35 |
| 6,263,763 | B1 * | 7/2001 | Feigel et al. | 81/57.34 |
| 6,318,214 | B1 * | 11/2001 | Buck | 81/57.35 |
| 6,431,029 | B1 * | 8/2002 | Hawkins, III | 81/57.25 |
| 6,752,044 | B2 * | 6/2004 | Hawkins, III | 81/57.34 |
| 2001/0025551 | A1 * | 10/2001 | Pietras | 81/57.34 |
| 2002/0088310 | A1 * | 7/2002 | Pietras | 81/57.34 |
| 2002/0157823 | A1 * | 10/2002 | Pietras et al. | 166/78.1 |

FOREIGN PATENT DOCUMENTS

| | | | |
|---|---|---|---|
| GB | 2302516 | A | 1/1997 |
| WO | WO02/03395 | A1 | 1/2002 |

* cited by examiner

*Primary Examiner*—Donald Underwood
(74) *Attorney, Agent, or Firm*—Jones, Walker, Waechter, Poitevent, Carrere, & Denegre, L.L.P.

(57) ABSTRACT

A power tong positioning apparatus having a base section and a backup elevating section engaging the base section. A first lift assembly is positioned between the base section and the backup elevating section while a tong elevating section engages the backup elevating section. A second lift assembly is then positioned between the backup elevating section and the tong elevating section.

14 Claims, 9 Drawing Sheets

DETAIL A
SCALE 1 : 10

REAR CLIP & SPROCKET
DETAIL A
SCALE 1 : 10

FRONT CLIP
DETAIL B
SCALE 1 : 10

POWER TONG POSITIONER

This application claims the benefit of U.S. Provisional Application No. 60/459,342 filed Apr. 1, 2003.

I. FIELD OF THE INVENTION

This invention relates to power tong assemblies used to grip drill pipe and other similar tubular members. More particularly, the invention relates to devices for positioning pipe handling tongs relative to a string of tubulars.

II. BACKGROUND OF THE INVENTION

Pipe tongs are often employed in the oil and gas industry to break apart or tighten together threaded tubular member connections. It is generally required that one set of pipe tongs grip and rotate one section of tubular member and one set of pipe tongs grip and hold stationary the other section of tubular member. Modern drilling operations usually employ powered pipe tongs, or power tongs. The first tong rotating the tubular member is typically referred to as the "power tong", while the second tong holding the tubular member stationary is typically referred to as the "backup tong" or simply "backup." Conventional power tongs include devices such as those disclosed in U.S. Pat. Nos. 5,671,961; 5,819,604; and 5,702,139 to Buck, which are incorporated herein by reference.

Power tongs are bulky and heavy tools, with larger tongs weighing more than 4,500 pounds and even smaller tongs weighing 900 to 1,800 pounds. To help handle these heavy tools, specialized devices have been developed to support the tongs and to move the tongs in and out of the position the tong occupies when working a string of tubulars. These devices are typically referred to as "tong positioners," examples of which may be seen in U.S. Pat. Nos. 6,142,042 and 6,318,214 to Buck which are incorporated herein by reference. However, there are improvements which may be made to these prior art tong positioners. Casing couplings and accessories utilized in casing strings often require the power tong and backup to be spaced further apart than is typical in prior art tong positioners. Additionally, it is often necessary to makeup or breakout casing joints at a comparatively greater height above the drill deck than when operating on other types of tubular strings. A device which addressed these and other difficulties would be a significant improvement in the art.

III. SUMMARY OF THE INVENTION

One embodiment of the present invention provides a power tong positioning apparatus comprising a base section and a backup elevating section engaging the base section. A first lift assembly is positioned between the base section and the backup elevating section while a tong elevating section engages the backup elevating section. A second lift assembly is then positioned between the backup elevating section and the tong elevating section.

Another embodiment of the power tong positioning apparatus comprises a base section and a backup tong movably positioned on the base section by a first lift assembly. Then a power tong is operatively connected to the backup tong by a second lift assembly such that the second lift assembly can generate relative vertical displacement between the backup tong and the power tong.

A still further embodiment of the power tong positioning apparatus comprises a backup elevating section having a backup support and a backup tong. The backup includes a quick release assembly constructed to removably and matingly engage the backup support. This embodiment further includes a tong elevating section having a tong support and a tong hanger supporting a power tong. The tong hanger also has a quick release assembly constructed to removably and matingly engage the tong support.

IV. BRIEF DESCRIPTION OF THE DRAWINGS

V. DETAILED DESCRIPTION OF THE INVENTION

Figure 1B:
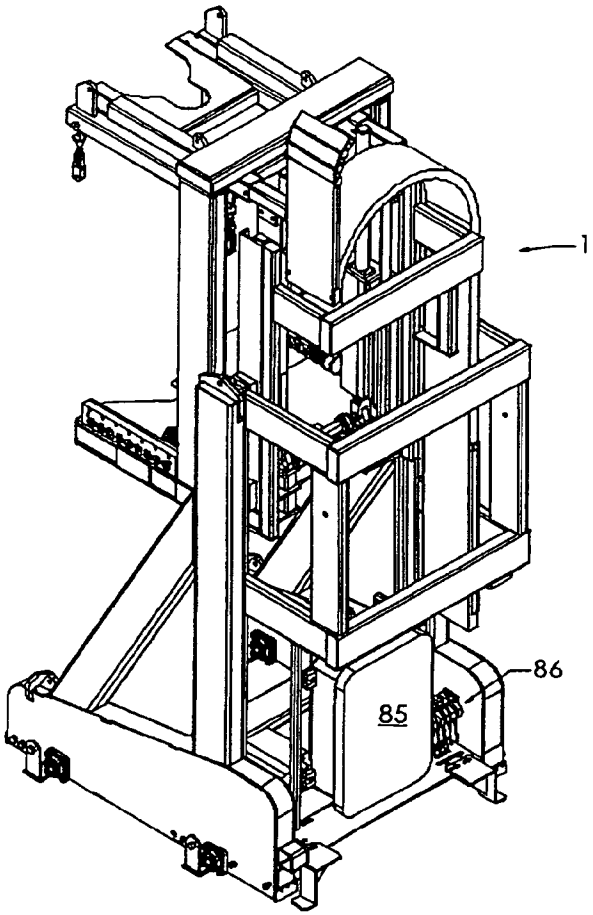
FIGS. 1A and 1B are a perspective view of one embodiment of the tong positioner of the present invention.
Figure 1A:
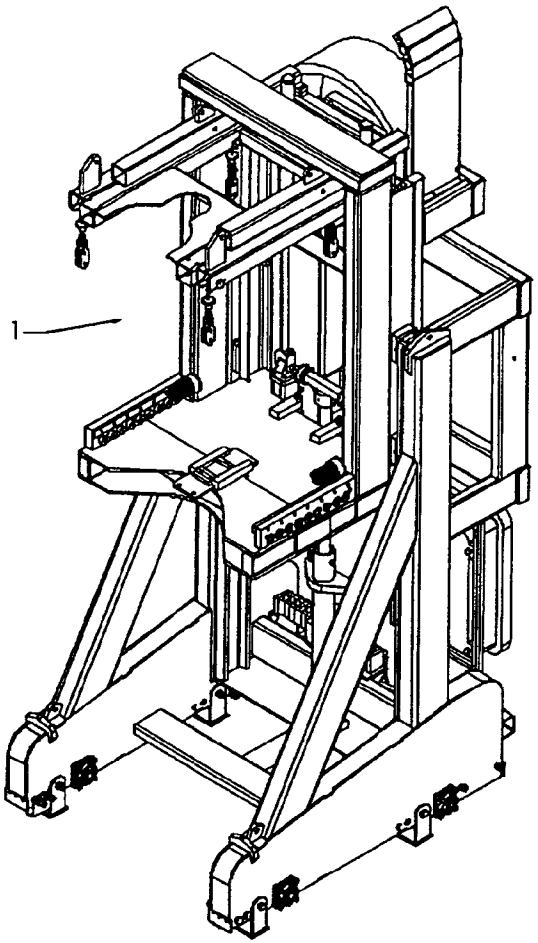
Figure 2:
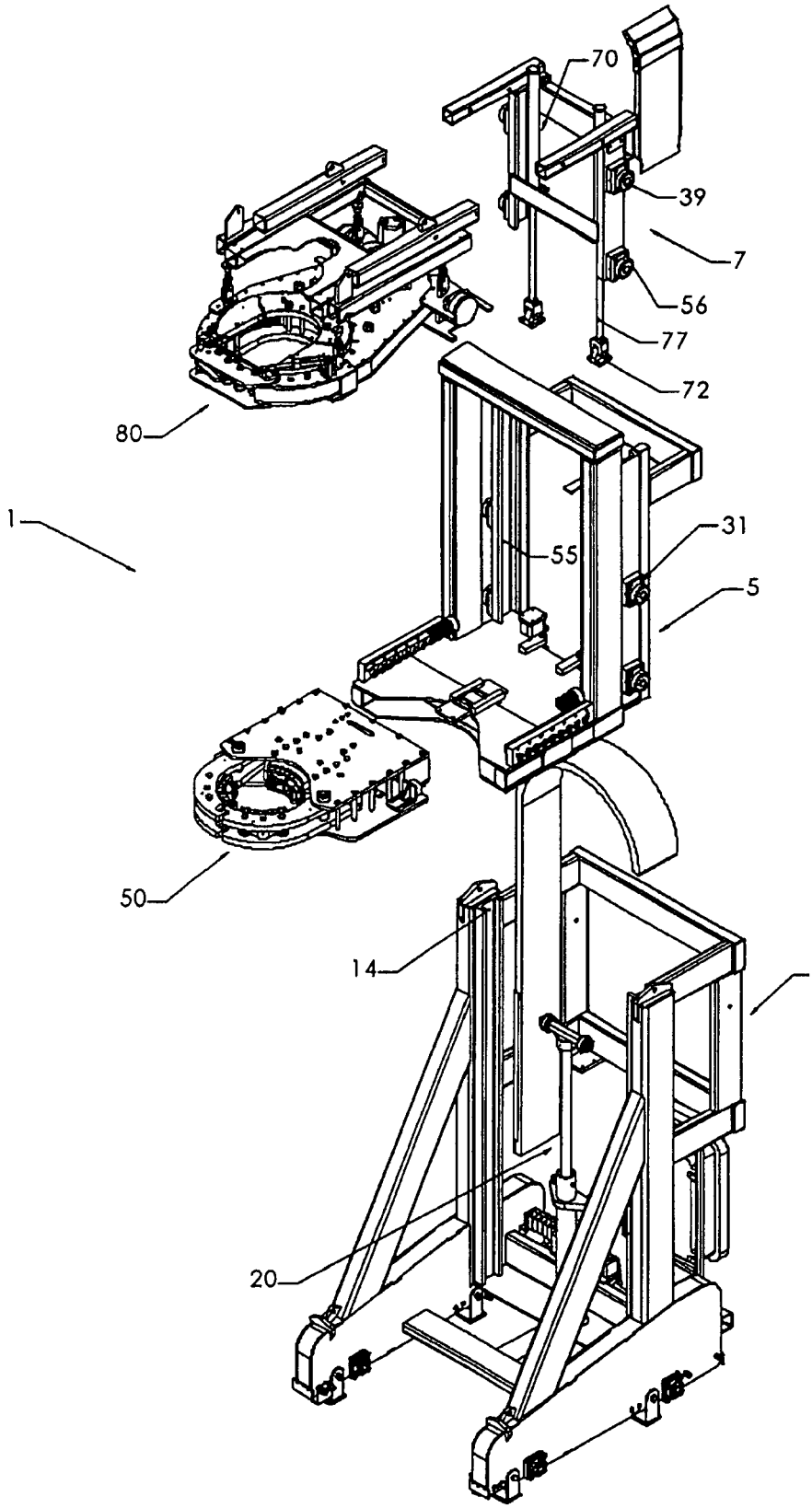
FIG. 2 is an exploded perspective view of the tong positioner seen in FIG. 1 and further including a power tong and backup tong.
Figure 3:
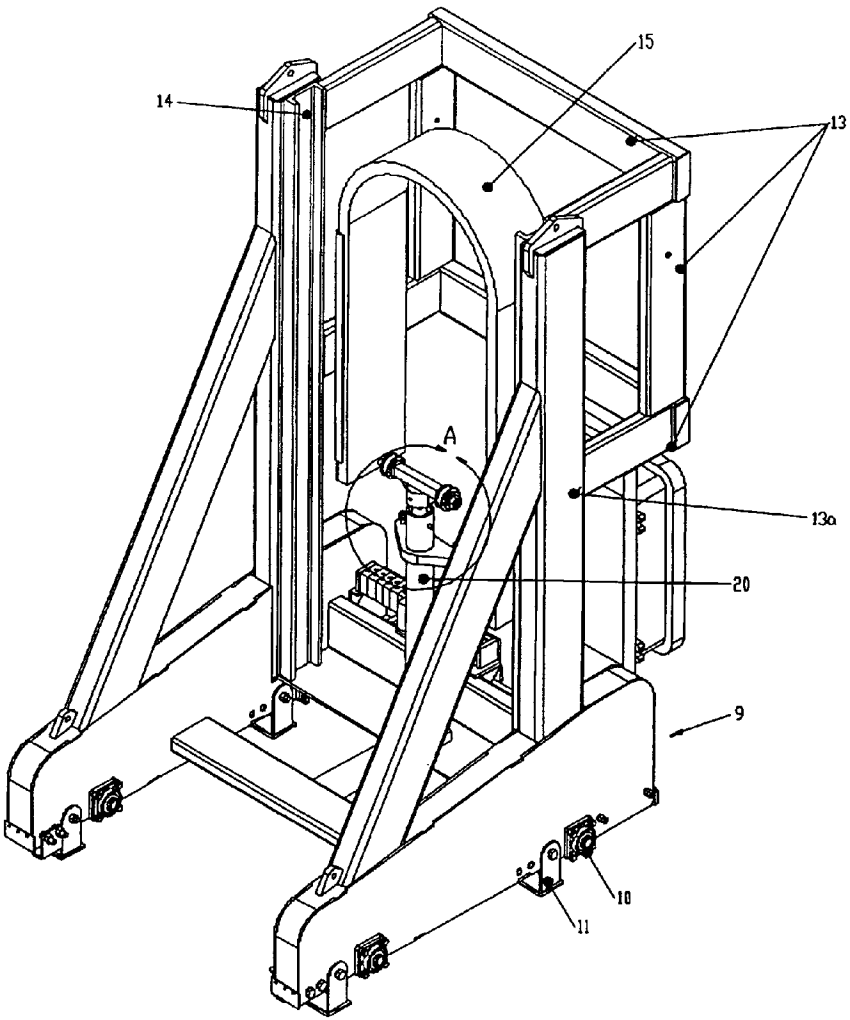
FIG. 3 is a perspective view of the base section of the tong positioner.
Figure 3:
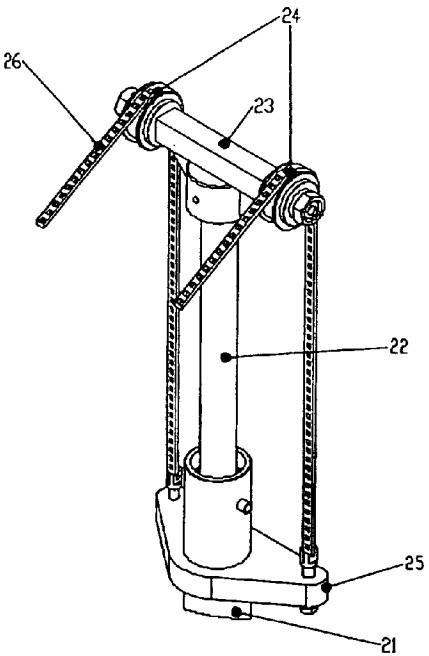

FIG. 1 illustrates one embodiment of the present invention, tong positioner 1, in its assembled state. The basic sub-components of tong positioner 1 are best seen in FIG. 2 and include base section 3, backup elevating section 5, and tong elevating section 7. FIG. 2 also shows a backup tong 50 and a power tong 80. As best seen in the more detailed view of FIG. 3, base section 3 is constructed of various frame members 13, which in one embodiment will be steel tubular members having generally rectangular cross-sections. Base section 3 will extend upward from footing section 9, including upright frame member 13*a*. A hose guide and protector 15 will accommodate the hydraulic hoses (not shown) which will extend from a hydraulic fluid source to the various hydraulic systems which are explained in more detail below.

Attached to the inside of upright frame member 13*a* is channel guide 14 which has a channel sized to accommodate rollers 31 (see FIG. 2) on backup elevating section 5. Base section 3 will also include first lift assembly or backup lift assembly 20. In the illustrated embodiment, a first or backup lift assembly 20 will include hydraulic cylinder 21 and rod 22 (which is attached to a piston internal to cylinder 21) with cross arm 23 positioned thereon. Cross arm 23 will have a pulley 24 on each of its ends and chains 26 attached to plate 25 on cylinder 21 will extend over pulleys 24. The free end of chains 26 will fasten to chain connectors 34 (see FIG. 4A) on backup elevating section 5. Still viewing FIG. 3, it can be understood how extension of rod 22 from cylinder 21 will tension the ends of chains 26 which are attached to chain connectors 34 and cause backup elevating section 5 to rise relative to base section 3. Naturally, retraction of rod 22 will allow backup elevating section 5 to lower relative to base section 3. In the embodiment shown, cylinder 21 and rod 22 are a double acting piston/rod/cylinder assembly.

Figure 4A:
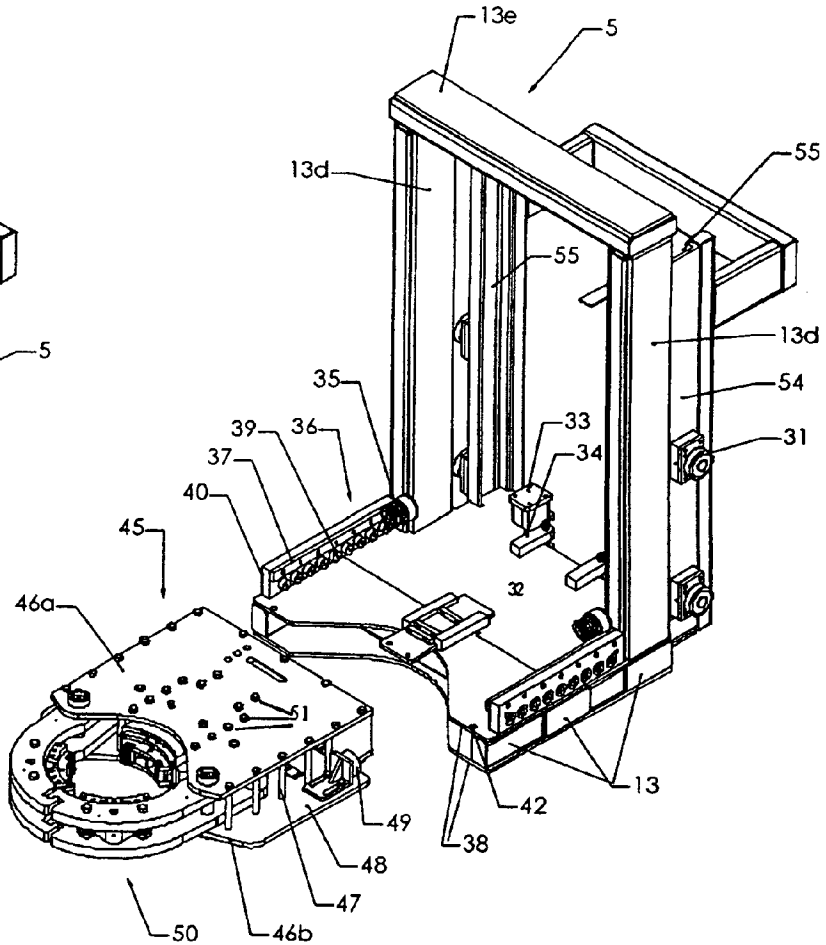
FIGS. 4A and 4B are perspective views of the backup elevating section of the tong positioner.

FIG. 4A is a more detailed illustration of backup elevating section 5 showing how this section generally comprises backup support frame 32 and several frame members 13 forming an upright structure. Attached to the upright frame members 13 are channel beams 54 having a guide channel 55. The rear surface of channel beams 54 will have rollers 31 attached thereto which engage the guide channels 14 as discussed above in reference to FIG. 3. Guide channels 55 will be sized to accommodate rollers 56 (see FIG. 5) on tong elevating section 7. Still viewing FIG. 4A, backup support frame 32 will comprise two plates 38 formed on several frame members 13. Items such as chain connectors 34 and piston rod footing 33 (explained below) will be positioned upon backup support frame 32. Additionally, backup support frame 32 will include slide supports 40 which have rollers 39 and roller guides 37 attached thereto.

Figure 4B:
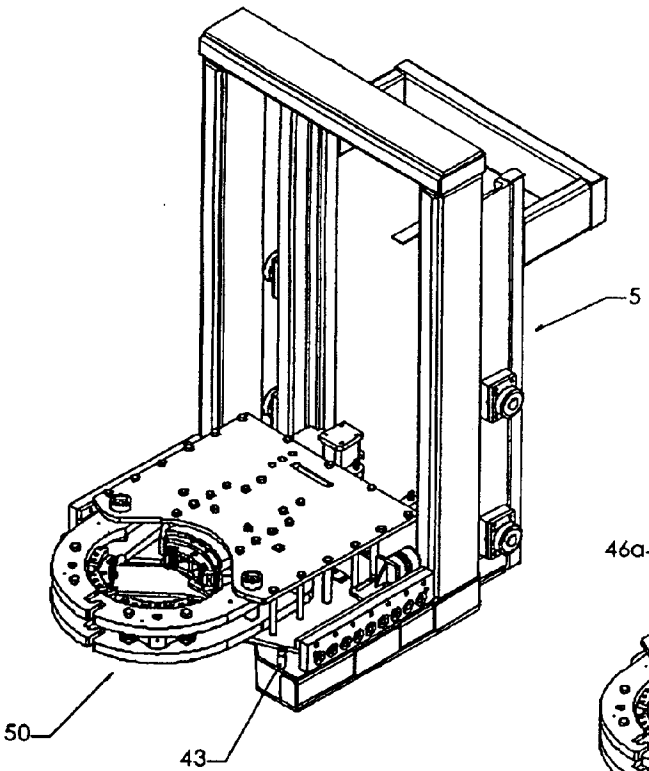

FIG. 4A also illustrates how backup tong 50 will include a specifically modified bottom plate 46*b*. Backup 50 generally includes a top plate 46*a* and a bottom plate 46*b* which are held together by a series of bolts 47 extending through plates 46*a* and 46*b*. In typical prior art backups, the top and bottom plates have generally the same shape. However, in the embodiment of FIG. 4, bottom plate 46*b* differs from top plate 46*a* in that the former includes a shelf lip 48 extending laterally beyond bolts 47. Positioned to the rear of shelf lip 48 on each side of backup 50 is an spring stop 49. As suggested in FIG. 4B, backup tong 50 engages backup support frame 32 by way of shelf lip 48 sliding between rollers 39 and roller guide 37. Spring stops 49 will come to rest against backup springs 35. Backup 50 will be secured against forward movement by the insertion of stop pins 43 in pin aperture 42 (see FIG. 4A). While the particular embodiments illustrated employ rollers and roller guides, the invention includes any type of suitable linear bearing system or low friction guide system. It will be understood that backup 50 may be quickly removed from backup support frame 32 by simply removing stop pin 43 and sliding backup 50 out of backup support frame 32. Typically stop pins 43 will position backup 50 far enough back on support frame 32 that spring stops 49 will place backup springs 35 under some compression, but still not completely compress springs 35. This allows springs 35 to bias backup 50 against stop pins 43, but still allows a small amount of rearward movement by backup 50 as may be necessary during its normal operation (particularly in relation to the interlocking jaw type of backup seen in FIG. 4).

Figure 5:
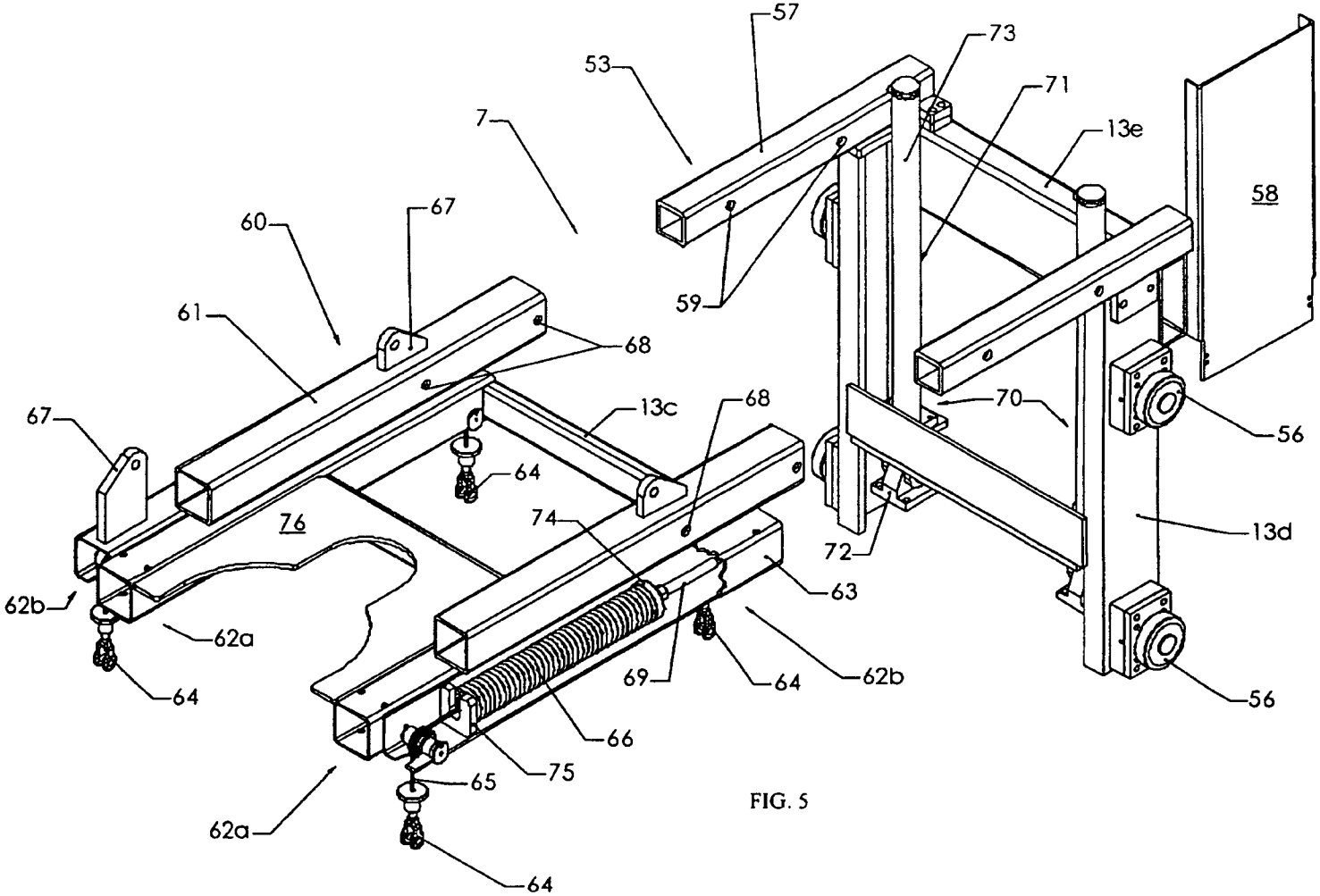
FIG. 5 is a perspective view of the power tong elevating section of the tong positioner.

A third major component of tong positioner 1 is tong elevating section 7, a detailed view of which is seen in FIG. 5. Tong elevating section 7 may be further broken down into frame portion 53 and tong hanger 60. Frame portion 53 is made up of various frame sections 13 with rollers 56 mounted on upright frame sections 13. Frame portion 53 will include the second lift assembly or tong hanger lift assembly 70. In the embodiment shown, this lift assembly 70 will be formed of two piston and cylinder assemblies 71, which include cylinders 73 bolted to upright frame members 13 and rod connectors 72 which are pivotally connected to the piston rods 77 (hidden from view in FIG. 5, but seen in FIG. 2) of the piston and cylinder assemblies. Rod connectors 72 will be attached to footings 33 described in relation to FIG. 4A. In the embodiment shown, piston and cylinder assemblies 71 are double acting piston and cylinder assemblies. A hose guide/protector 58 will also be attached to the rear of frame portion 53. Finally, support arms 57, which are rectangular steel bars in the illustrated embodiment, will be bolted to and extend from frame sections 13 and will include pin apertures 59.

Tong hanger 60 will comprise support sleeves 61 which are tubular members sized to slide over support arms 57 and are secured thereto by pin apertures 68 and 59 being aligned and pinned. Support sleeves 61 will be welded or otherwise attached to spring hangers 62. Spring hangers 62 are well known in the art and may be seen in references such as U.S. Pat. Nos. 6,142,042 and 6,318,214. Within each spring hanger 62, a cable 65 extends over a pulley (hidden from view), extends through stop plate 75 and connects to rod 69 using a swage or other suitable means. Rod 69 has a threaded end opposite the end connected to cable 65 to allow a nut to engage rod 69 and position spring washer 74. A spring 66 is positioned over the connection of rod 69 and cable 65 and extends between stop plate 75 and spring washer 74. The end of cable 65 not attached to rod 69 will be attached to tong connector 64. It will be understood that the weight of the power tong on cable 65 pulls rod 69 (and spring washer 74) against spring 66 which resists the weight of the power tong, but still allows some vertical displacement of the power tong. The two outer tong hangers 62*b* will provide the forward tong connectors 64 and the two inner tong hangers 62*a* will provide the rear tong connectors 64. A support plate 76 and frame member 13*c* will rigidly fix the positions of the spring hangers 62. In the embodiment shown, tong hanger 60 will also include lifting eyes 67 to assist in handling tong hanger 60.

Figure 6:
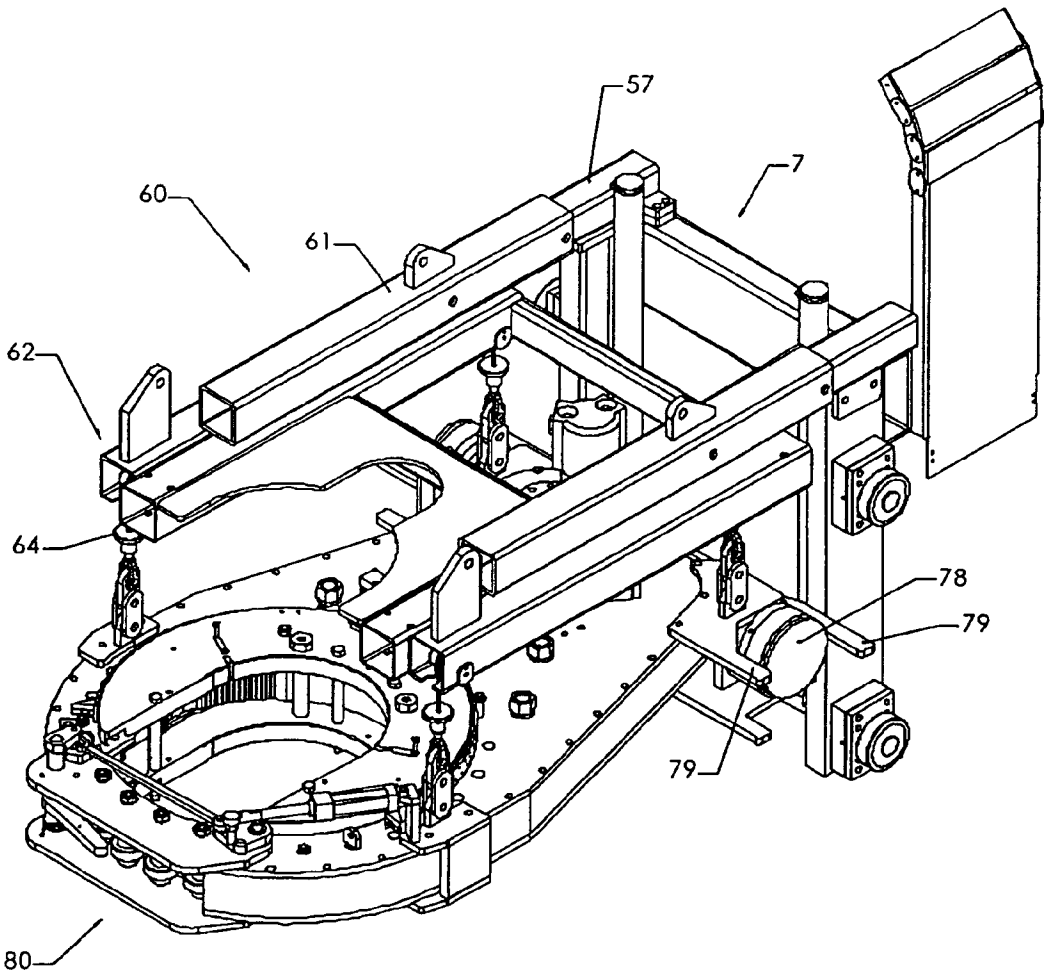
FIG. 6 is a perspective view of the power tong elevating section with a power tong attached thereto.

FIG. 6 illustrates tong elevating section 7 assembled and supporting a power tong 80. Power tong 80 is suspended from tong hanger 60 by way of tong connectors 64 and the support sleeves 61 are positioned over support arms 57. Also connected to the rear on each side of power tong 80 are load cells 78 (which may be hydraulically or electrically activated) and guide forks 79. Although not specifically shown, it will be understood that guide forks 79 will engage and slide along the inside surface of frame structure 13*d* (see FIG. 4A) of tong elevating section 5. When power tong 80 applies torque to a tubular member, the body of power tong 80 will tend to rotate in the opposite direction, pressing one of the load cells 78 into frame member 13*d*. As is known in the art, the load generated at load cell 78 will allow calculation of the torque being applied to the tubular member.

Viewing FIGS. 1 and 2, it can be envisioned how tong positioner 1 operates to adjust the vertical position of both backup tong 50 and power tong 80. When rollers 31 on backup elevating section 5 engage the channels 14, the raising and lowering of backup lift assembly 20 will raise and lower backup elevating section 5 (and thus backup tong 50). Naturally, the raising and lowering of backup elevating section 5 will simultaneously move tong elevating section 7. However, the sliding of rollers 56 in channels 55 and the use of tong hanger lift assembly 70 further allows for vertical movement of tong elevating section 7 relative to backup elevating section 5. The present invention also provides for the quick and easy removal of one size power tong and backup with another size as may be needed in normal operations. To remove backup 50, it is only necessary to remove stop pins 43, slide backup 50 out of support frame 32 and insert another backup 50 secured in place with stop pins 43. Likewise, tong hanger 60 can be unpinned from support arms 57 and quickly replaced with another tong positioned on a similar tong hanger 60. It can be seen that the shelf lip 48 interacting with rollers 39 and tong hanger support sleeves 61 interacting with support arms 57 both form quick release assemblies for allowing rapid replacement of the power tong and backup. Naturally, the power tong and backup quick release assemblies are not limited to the structures shown in the drawings and could include any mechanism that accomplishes a similar expedited removal process.

It will also be apparent that the heavy structure of frame members 13 will stabilize backup 50 and power tong 80 against torque imparted to those devices while makingup or breakingout tubulars. In the embodiment shown, frame members 13*d* and 13*e* in the backup and power tong elevating sections will be formed of reinforced steel members.

Figure 7B:
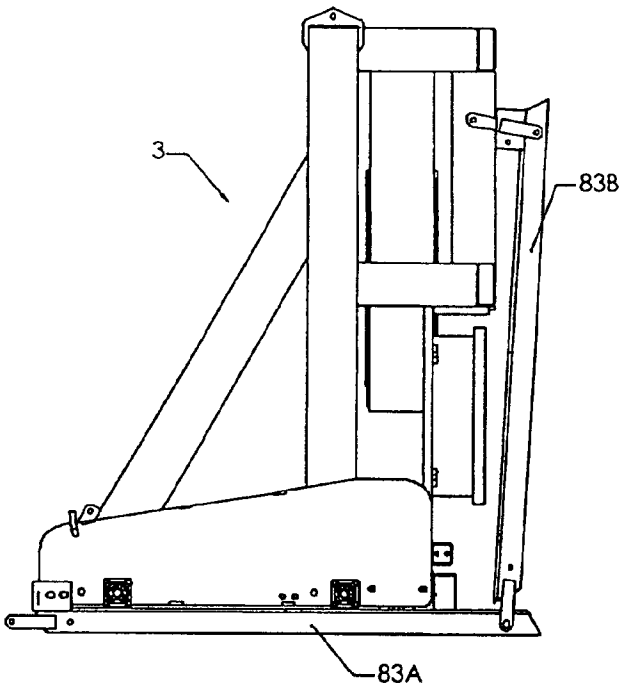
FIGS. 7A and 7B illustrate a track mechanism for moving the tong positioner toward and away from the tubular string.
Figure 7A:
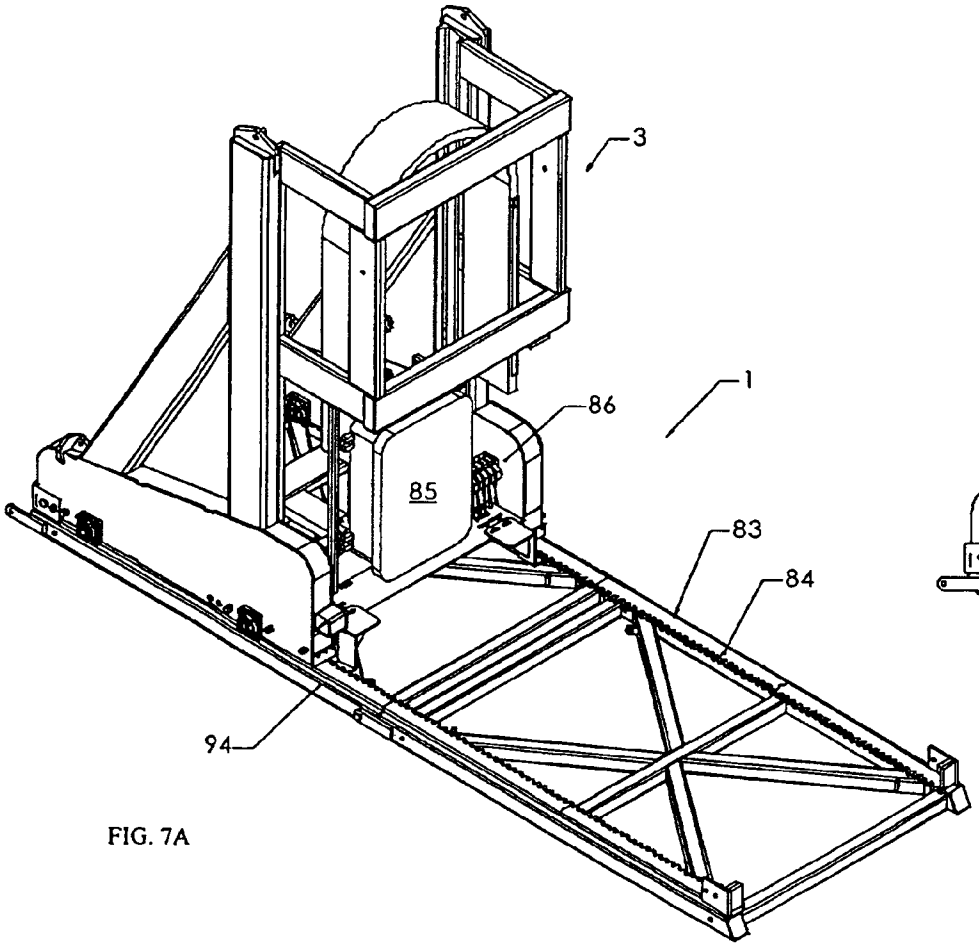
Figure 8B:
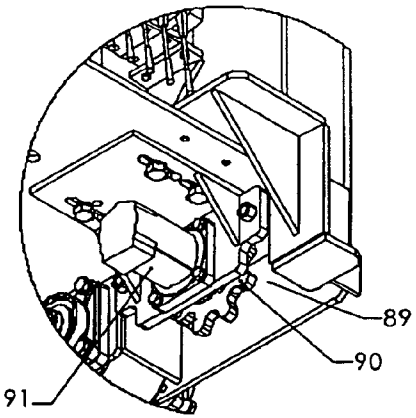
FIG. 8 illustrates the motor mechanism for engaging the tracks shown in FIG. 7A.
Figure 8C:
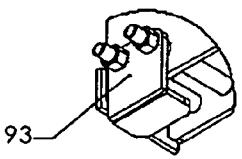
Figure 8A:
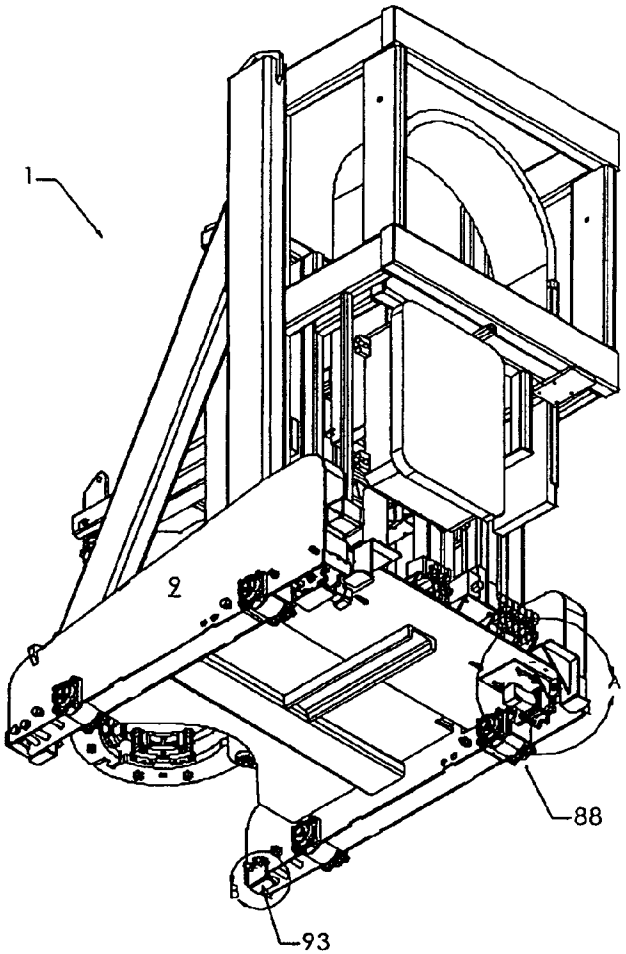

In many instances, it is also desirable for tong positioner 1 to be capable of moving in a horizontal direction toward and away from the tubular string. FIGS. 7A and 7B illustrate a tong positioner which has this capability. Tong positioner 1 will be installed on a track segment 83 having inward facing track teeth 84. In one embodiment, track segment 83 is divided into segments 83*a* and 83*b* which are pivotally connected and allows segment 83*b* to fold up behind base segment 3 of tong positioner 1 as seen in FIG. 7B. As best seen in FIGS. 8A-8C, the movement of this embodiment of tong positioner 1 is accomplished by a series of support wheels 88 and drive wheels 89 positioned within the footing section 9 of tong positioner 1. Four support wheels 88 will have the bearing capacity to carry the weight of tong positioner 1 and in one embodiment support wheel 88 will be formed of steel rollers having integral shafts supported by flange bearings. As best seen in FIG. 8B, the rear of footing section 9 will also include drive wheels 89 comprising a sprocket type wheel 90 powered by hydraulic motor 91. When drive wheels 89 rotate, the sprocket wheels 90 engage track teeth 84 to propel tong positioner 1 forward or rearward depending on the direction of motor 91's rotation. To assist in maintaining bearing wheels 88 and drive wheels 89 on track 83, L-shaped retaining clips 93 (see FIG. 8C) will be positioned at the bottom of footing section 9 and will engage a lip 94 (see FIG. 7A) formed on the outer edge of track 83. In addition to performing a guiding function, clips 93 also help retain positioner 1 on track 83 when the positioner is subject to moderate overturning loads (e.g. heavy seas or operator errors). Nor is the present invention limited to operation on the track seen in FIG. 7A. The inventive concept includes capabilities to operate on other conventional track systems such as the Iron Roughneck™ produced by Varco International of Orange, Calif. The present invention could also include many other self propelling mechanisms such as by way of non-limiting examples, tires with a torque source mounted in footing section 9 or alternatively, caterpillar type tracks mounted in footing section 9.

Figure 9:
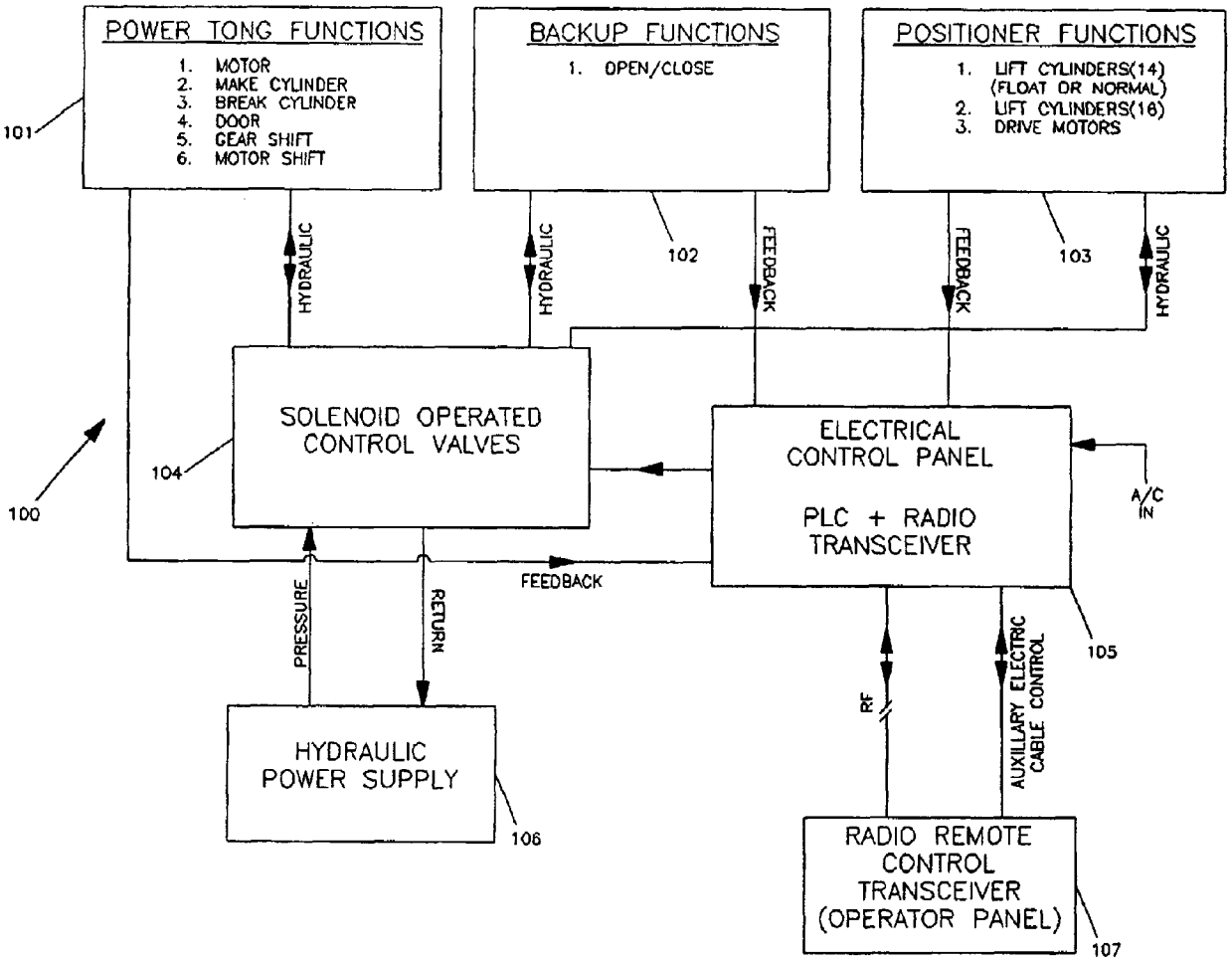
FIG. 9 is a schematic of the hydraulics system used to control the functions of one embodiment of the tong positioner and tongs.

In the embodiment of tong positioner 1 illustrated in the figures, the motive power for various components such as power tongs, lift assemblies, and drive wheel motors will be pressurized hydraulic fluid. FIG. 9 is a schematic depiction of the hydraulic system employed in one embodiment of the present invention. Hydraulic supply 106 will comprise a source of pressurized hydraulic fluid, typically a fluid reservoir and a hydraulic pump. Hydraulic fluid will be directed to various components and returned to supply 106 through a bank of solenoid operated control valves 104. Control valves 104 will in turn be operated by an electrical controller 105. In the embodiment shown, controller 105 includes a programmable logic chip communicating with a radio transceiver. The radio transceiver allows communication with remote control transceiver 107. Typically, remote control transceiver 107 will provide a wireless (i.e. RF, IR, etc.) communication link between the remote control 107 and controller 105. Alternatively or as a backup to the wireless link, there may be an auxiliary electric or fiber optic cable running between remote control 107 and controller 105. In the embodiment shown in FIG. 7A, control box 85 will house the components for control valves 104 and controller 105.

Control valves 104 will operate power tong functions 101 such as the magnitude of torque applied, direction of torque applied (i.e., whether making up or breaking out tubulars), the motor speed and gear shift functions of the power tong, and the opening/closing of the power tong door. Likewise, backup functions 102 will include opening and closing the backup tong while positioner functions will include operating the drive motors 91 and the piston and cylinders in lift assemblies 20 and 70. While lift assembly 20 only provides the relatively simple function of raising and lowering backup elevating section 5, lift assembly 70 operates in both a "float" and a normal mode. The normal mode consists of extending and retracting the piston 77 to raise and lower the lift assembly 70. The float mode will allow the power tong 80 to change position with the exertion of minimal external force. For example, the piston and cylinder assembly 71 will be supplied with a fluid at a sufficient pressure (P1) to maintain lift assembly 70 at a given position against the weight of power tong 80. A relief valve in fluid communication with cylinder 73 will release the fluid pressure in cylinder 73 if the pressure exceeds P1. If a downward force is applied to power tong 80 and increases the pressure in cylinder 73 beyond P1, the relief valve will allow fluid to exit cylinder 73 and allow lift assembly 70 (along with power tong 80) to settle downward until the pressure in cylinder 73 returns to P1. On the other hand, if an upward force is applied to power tong 80, this will tend to reduce the pressure in cylinder 73 to less than P1. A sensor fluidly connected to cylinder 73 will detect this change in pressure and transfer fluid to cylinder 73 until a pressure of P1 is re-established. Thus, lift assembly 70 will continue to rise while there is an external upward force acting on power tong 80. This "float" mode will allow movement of power tong 80 in response to significantly less external force (in one embodiment approximately 100 lbs.) than is required to displace the heavy springs in spring hangers 62.

While this application describes the present invention in terms of certain specific embodiments, many variations and modifications will come within the present inventive intent. For example, while tong hanger lift assembly 70 (and backup lift assembly 20) are shown as employing piston and cylinder devices, all other suitable lifting devices (e.g. power screws, pneumatic lifts, winch and cable systems, rack and pinion arrangements, and other linear actuators) are intended to come within the scope of the present invention. Likewise, while the embodiment discussed above is radio controlled, all functions of tong positioner 1 could be controlled by manually operated valves such as those seen at 86 in FIG. 7A. Or as a further alternative, as opposed to solenoid activated valves, tong and positioner functions could be controlled by hydraulic or pneumatic pilot valves activating the main control valves. These and all other obvious variations and modifications are intended to come within the scope of the following claims.

We claim:

1. A power tong positioning apparatus comprising:

a. a base section;

b. a backup elevating section slidingly engaging said base section and including a backup support;

c. a first lift assembly between said base section and said backup elevating section;

d. a tong elevating section comprising a power tong, said tong elevating section slidingly engaging said backup elevating section;

e. a second lift assembly between said backup elevating section and said tong elevating section;

f. a backup tong having a shelf lip to engage said backup support;

g. wherein said tong elevating section includes at least one roller engaging a guide channel to move said tong elevating section relative to said backup elevating section.

2. The power tong positioning apparatus of claim 1, wherein said tong elevating section has a tong support and a tong hanger supporting a power tong, said tong hanger constructed to removably and matingly engage said tong support.

3. The power tong positioning apparatus of claim 1, further including self-propelling system upon which said base section may travel forward and rearward.

4. The power tong positioning apparatus of claim 1, further including a means for said base section to travel forward and rearward.

5. The power tong positioning apparatus of claim 3, wherein said self propelling system includes a caterpillar continuous track system.

6. The power tong positioning apparatus of claim 3, wherein said self-propelling system includes a track and at least one motor powering drive wheels engaging said track.

7. The power tong positioning apparatus of claim 1, wherein said first and second lift assemblies are activated by a hydraulics system and said hydraulics system is operated by a wireless controller.

8. The power tong positioning apparatus of claim 1, wherein said first and second lift assemblies are activated by a hydraulic system.

9. The power tong positioning apparatus of claim 1, wherein said first and second lift assemblies are activated by a hydraulics system and said hydraulics system is operated by manual controls or by pneumatic or hydraulic pilot valves.

10. The power tong positioning apparatus of claim 2, wherein said first and second lift assemblies, said power tong, and said backup tong are activated by a hydraulics system and said hydraulics system is operated by a wireless controller.

11. A power tong positioning apparatus comprising:

a. a base section;

b. a backup elevating section slidingly engaging said base section and including a backup support;

c. a first lift assembly between said base section and said backup elevating section;

d. a tong elevating section including a power tong, said tong elevating section slidingly engaging said backup elevating section;

e. a second lift assembly between said backup elevating section and said tong elevating section;

f. a backup tong including a plate lip sliding on a set of rollers formed on said backup support;

g. wherein said tong elevating section includes at least one roller engaging a guide channel to move said tong elevating section relative to said backup elevating section.

12. The power tong positioning apparatus of claim 1, wherein said first and second lift assemblies comprise linear actuators.

13. The power tong positioning apparatus of claim 1, wherein said first and second lift assemblies comprise a means for elevating said assemblies.

14. The power tong positioning apparatus of claim 12, wherein said linear actuators comprise hydraulic piston and cylinder assemblies.

* * * * *